United States Patent [19]

Jenkinson, Jr.

[11] Patent Number: 4,760,869

[45] Date of Patent: Aug. 2, 1988

[54] LOOM REED

[75] Inventor: Charles B. Jenkinson, Jr., Greenwood, S.C.

[73] Assignee: Milliken Research Corporation, Spartanburg, S.C.

[21] Appl. No.: 53,030

[22] Filed: May 22, 1987

[51] Int. Cl.[4] ..... D03D 49/60

[52] U.S. Cl. ..... 139/188 R; 139/192; 139/429

[58] Field of Search ..... 139/429, 430, 302, 303, 139/370.2, 188 R, 192

[56] References Cited

U.S. PATENT DOCUMENTS 3,147,778 9/1964 Reyes ..... 139/303

4,531,555 7/1985 Tatematsu et al. ..... 139/302

FOREIGN PATENT DOCUMENTS 29070 9/1975 Japan ..... 139/302

*Primary Examiner*—Henry S. Jaudon

*Attorney, Agent, or Firm*—Earle R. Marden; H. William Petry

[57] ABSTRACT

A weaving machine reed which has a protective strip connected to the reed on the end adjacent the fill yarn insertion deviçe. The protective strip basically consists of a vetically elongated piece of metal with a ceramic material mounted centrally of the strip to provide a protective surface.

7 Claims, 1 Drawing Sheet

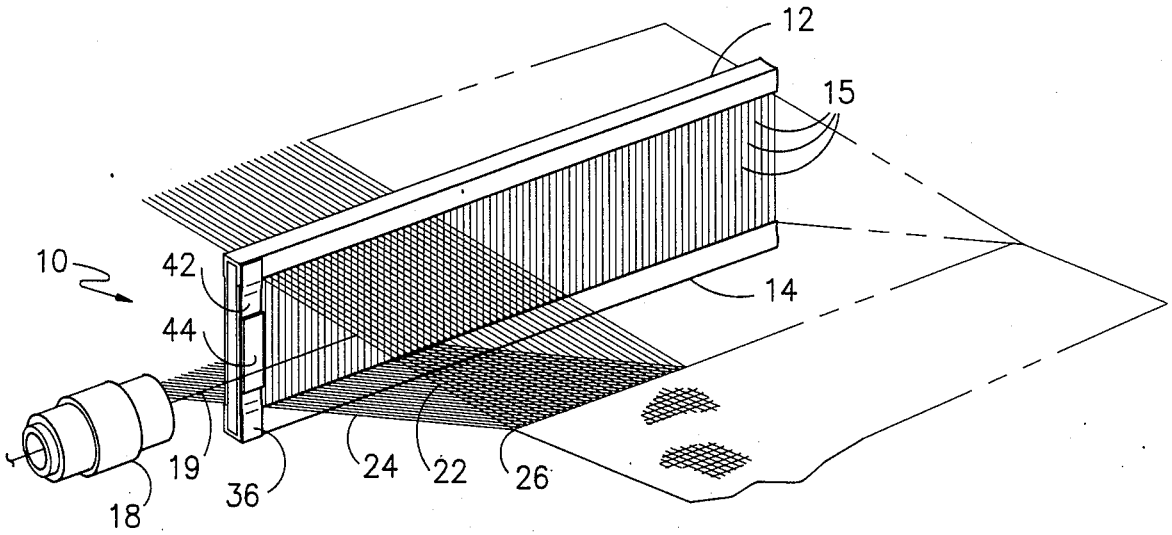
FIG. -1-
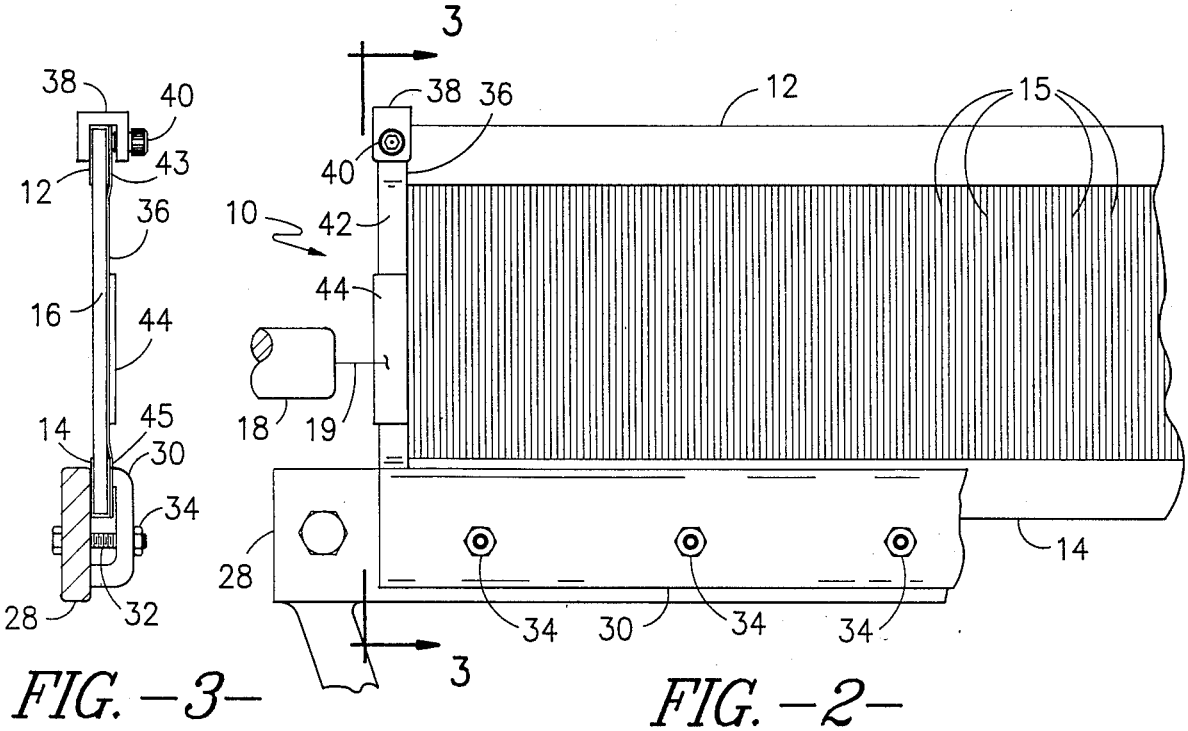
FIG. -3-
FIG. -2-
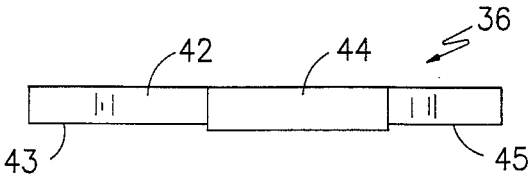
FIG. -4-
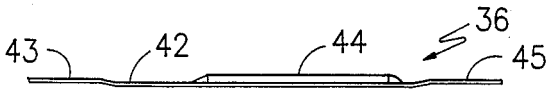
FIG. -5-

LOOM REED

This invention relates to an improved reed for a weaving machine and in particular to a water jet weaving machine which is utilizing an abrasive fill yarn such as a continuous filament or staple fiber synthetic yarn.

It is therefore an object of the invention to provide a new and improved reed for a weaving machine which eliminates wear on the inlet side of the reed.

Other objects and advantages of the invention will become readily apparent as the specification proceeds to describe the invention with reference to the accompanying drawing, in which:

FIG. 1 is a schematic representation of a portion of a water jet loom showing the use of the new and improved reed;

FIG. 2 is a blown-up front view of the left-hand portion of the reed shown in FIG. 1;

FIG. 3 is a section view taken on line 3—3 of FIG. 2.

FIG. 4 is one view of the reed protector used on the reeds of FIGS. 1–3, and FIG. 5 is a side view of the reed protector shown in FIG. 4.

Looking now to FIG. 1, the new and improved reed 10 is shown schematically in a weaving environment. The reed 10 basically consists of an upper channel member or strip 12 and lower channel member or strip 14 having channels therein to accommodate the dents 15 therein. Located on both ends of the reed is the vertical end strip 16 which is welded or otherwise secured to the upper and lower channel strip 12 and 14, respectively.

A weft insertion device is illustrated schematically at 18 which inserts a weft yarn 19, coming from a supply package (not shown), through a shed formed between the parted upper and lower warp yarns 22 and 24 as illustrated. The inserted weft yarn is then beaten-up into the cloth at the fell 26 of the cloth. The reed undergoes a driving motion from the position shown in FIG. 1 to a beat-up position at the fell 26 of the cloth by means of a conventional reed lay drive.

The reed 10 is secured to the lay beam 28 by the elongated clamp member 30 secured by any suitable means such as bolt 32 and nut 34. Also secured by the clamp member 30 is the reed protective strip 36 which overlies the end strip 16 and is secured to the reed 10 at the top by a U-shaped clamp 38 held in place by a thumb screw 40. As shown in detail in FIGS. 4 and 5, the protective strip 36 consists of an elongated metal base 42 of copper, aluminum, etc. to which is attached centrally thereof a ceramic material 44. The ceramic material 44, when the strip is mounted on the reed, faces the take-up side of the loom and lies between the reed and the fill yarn.

The metallic base 42 is bent outwardly at the upper and lower ends 43 and 45, repsectively, to accommodate the upper and lower dent channel members 12. The ceramic member 44, adhered to the metallic base 42 by any suitable means such as an epoxy, provides two basic functions. The ceramic material is not readily abraded by the synthetic fill yarn passing thereover thereby eliminating the problem of wear on the end strip 16 previously encountered. Furthermore, it provides a protective surface when the reed is moved forward on the beat-up and the yarn cutter is engaged by the fill yarn 19. The ceramic material 44 prevents the yarn cutter (not shown) from contacting the end of the reed 10.

Although the preferred embodiment of the invention has been described it is contemplated that changes may be made without departing from the scope or spirit of the invention and it is desired that the invention be limited only by the scope of the claims.

I claim:

1. An improved reed for a weaving machine comprising: an upper channel member, a lower channel member, a plurality of dents mounted between said channel members and spaced apart from one another and means mounting an elongated strip between said channel chamber at one end of said reed said strip having a ceramic material mounted between the ends thereof facing in an outward direction.

2. The reed of claim 1 wherein said elongated strip is bent outwardly at the top and bottom thereof to accommodate the upper and lower channel members.

3. A machine for the weaving of fabric and having a lay member and a reed, said reed comprising: an upper and lower channel member with dents therein spaced from one another, a vertical support member located at one end of said reed and mounted between said upper and lower channel members, means mounted said reed to the lay member of said machine and means mounting a reed protective member over said one vertical support member, said reed protective member having a ceramic portion mounted between its ends and facing outwardly.

4. The machine of claim 3 wherein said means secures said reed protective member at the bottom thereof and a second means secures the top of said reed protective member to the top of said reed.

5. The machine of claim 4 wherein said second means includes a U-shaped member telescoped over said upper channel and the upper end of said reed protective member.

6. The machine of claim 4 wherein said reed protective member is bent outwardly at the top and bottom thereof to fit over the outside of said upper and lower channel members.

7. The machine of claim 6 wherein said second means includes a U-shaped member telescoped over said upper channel and the upper end of said reed protective member.

* * * * *